United States Patent [19]

Bishop et al.

[11] Patent Number: 4,499,174

[45] Date of Patent: Feb. 12, 1985

[54] HYDROPHILIC LAYERS ADJACENT A STRIPPING LAYER FOR DIFFUSION TRANSFER ASSEMBLAGES

[75] Inventors: John F. Bishop, Rochester; Thomas O. Braun, Webster, both of N.Y.

[73] Assignee: Eastman Kodak Company, Rochester, N.Y.

[21] Appl. No.: 592,766

[22] Filed: Mar. 26, 1984

Related U.S. Application Data

[63] Continuation-in-part of Ser. No. 497,472, May 23, 1983, abandoned.

[51] Int. Cl.[3] ..... G03C 1/40; G03C 5/54; G03C 11/12

[52] U.S. Cl. ..... 430/215; 430/212; 430/220; 430/223; 430/227; 430/236; 430/259; 430/262; 430/263; 430/954

[58] Field of Search ..... 430/212, 215, 227, 259, 430/262, 263, 220, 223, 236, 954

[56] References Cited

U.S. PATENT DOCUMENTS

| | | | |
|---|---|---|---|
| 3,674,482 | 7/1972 | Haberlin | 430/228 |
| 3,730,718 | 5/1973 | Danhauser | 430/212 |
| 4,076,529 | 2/1978 | Fleckenstein et al. | 430/223 |
| 4,298,682 | 11/1981 | Bishop | 430/215 |
| 4,359,518 | 11/1982 | Hanselman et al. | 430/236 |
| 4,377,632 | 3/1983 | Pflingston | 430/212 |

*Primary Examiner*—Richard L. Schilling
*Attorney, Agent, or Firm*—Harold E. Cole

[57] ABSTRACT

Photographic assemblages and processes are described wherein a stripping layer is employed to enable an image-receiving layer to be separated from the rest of the assemblage after processing. Each side of the stripping layer has a hydrophilic layer immediately adjacent thereto, only one of which contains particulate material substantially insensitive to light and in a volume percentage of about 5 to about 75 percent of the hydrophilic material-particulate material mixture, so that upon separation, substantially all of the stripping layer will remain with the portion of the assemblage having the hydrophilic layer containing the particulate material.

Transparencies or prints which are less bulky can thereby be obtained from integral assemblages.

34 Claims, No Drawings

HYDROPHILIC LAYERS ADJACENT A STRIPPING LAYER FOR DIFFUSION TRANSFER ASSEMBLAGES

This invention relates to photography, and more particularly to black-and-white and color diffusion transfer photography wherein a stripping layer with adjacent hydrophilic layers, one of which contains particulate material in a certain amount, is employed to enable an image-receiving layer to be cleanly separated from the rest of the assemblage after processing. In a preferred embodiment, the separated image-receiving layer has substantially none of the stripping layer adhered thereto.

Various formats for color, integral transfer elements are described in the prior art, such as U.S. Pat. Nos. 3,415,644; 3,415,645; 3,415,646; 3,647,437; 3,635,707; 3,756,815, and Canadian Pat. Nos. 928,559 and 674,082. In these formats, the image-receiving layer containing the photographic image for viewing remains permanently attached and integral with the image generating and ancillary layers present in the structure when a transparent support is employed on the viewing side of the assemblage. The image is formed by dyes, produced in the image generating units, diffusing through the layers of the structure to the dye image-receiving layer. After exposure of the assemblage, an alkaline processing composition permeates the various layers to initiate development of the exposed photosensitive silver halide emulsion layers. The emulsion layers are developed in proportion to the extent of the respective exposures, and the image dyes which are formed or released in the respective image generating layers begin to diffuse throughout the structure. At least a portion of the imagewise distribution of diffusible dyes diffuse to the dye image-receiving layer to form an image of the original subject. The user does not have to time this process.

A problem with the integral assemblages described above is that the silver halide and other imaging layers, the spent pod which originally contained processing fluid, and the trap which retains excess processing fluid remain with the print after processing. The resulting prints are bulky and are somewhat difficult to stock or store in albums.

Peel-apart formats for color diffusion transfer assemblages have previously been described, for example, in U.S. Pat. Nos. 2,983,606, 3,362,819 and 3,362,821. In these formats, the image-receiving element must be separated from the photosensitive element after a certain amount of time has elapsed, usually about one minute. This requires the customer to time the process which may be a disadvantage if a clock is not available. Also, the portion of the assemblage to be discarded is wet with caustic processing fluid, and care must be taken with its handling.

It would be desirable to provide a diffusion transfer assemblage in which a print can be obtained without the spent imaging layers, pod and trap, as in the peel-apart format described above, but with the elimination of the necessity for timing the process and the handling of wet discarded materials, as in the integral format described above. Such a print would comprise the support, dye image-receiving layer and reflecting layers only, and would more closely resemble conventional prints in appearance and handling.

*Research Disclosure,* Vol. 176, December 1978, Item 17622 discloses image transfer formats and concepts for removal of expended processing materials from image transfer units after processing. No specific materials are disclosed in this reference, however.

U.S. application Ser. No. 478,936 of Bishop et al, filed Mar. 25, 1983, relates to perfluorinated stripping agents for diffusion transfer assemblages. The use of hydrophilic layers on both sides of the stripping layer, one of which contains particulate material, is not disclosed in that application, however.

U.S. Pat. No. 2,977,226 relates to diffusion transfer assemblages wherein stripping layers are employed to separate two image-receiving layers from photosensitive layers. That patent, however, does not disclose the use of hydrophilic layers on either side of the stripping layer, one of which contains particulate material as described herein.

U.S. Pat. No. 3,730,718 relates to diffusion transfer assemblages wherein a stripping layer is employed in a diffusion transfer assemblage so that an image-receiving layer may be separated from a light-sensitive element during development. In the example in that patent, a stripping layer is employed between layers, both of which contain particulate material. However, assemblages wherein particulate material is present in layers on both sides of a stripping layer exhibit nonuniform fracture of the stripping layer upon separation, with the disadvantages as described below.

U.S. Pat. No. 4,359,518 also relates to diffusion transfer assemblages wherein a stripping sheet is employed in conjunction with a release layer to effect stripping a photosensitive layer from a film unit after processing. Particulate material such as silica particles are employed in a timing layer of the stripping sheet to prevent blocking and to function as an antistatic agent. In Example A of that patent, a release layer is employed between a silver halide emulsion layer and a "protective layer", the composition of which appears to be unknown. This patent, however, does not disclose the use of a hydrophilic layer located between the stripping layer and the silver halide emulsion layer and which contains particulate material as described herein.

U.S. Pat. No. 4,377,632 relates to the use of a strippable layer between an image-receiving layer and an antihalation layer. That patent, however, does not disclose the use of another hydrophilic layer located between the image-receiving layer and the stripping layer, as described herein, to obtain the advantages of this invention.

A problem has developed with the use of stripping layers in several of the assemblages described above. While it is highly desirable to have the stripping layer be removed in one uniform piece and remain with the separated portion that is to be discarded, in practice it has been found that the stripping layer itself fractures. This results in portions of the stripping layer randomly adhering to the two separated surfaces. A very blotchy appearance thus results on the back of the separated image-receiving layer which is undesirable in a commercial product. This blotchy appearance is particularly noticeable in $D_{min}$ areas of a transparency format.

It would be desirable to find a way to eliminate the nonuniform fracturing of a stripping layer in diffusion transfer assemblages as described above, so that substantially all of the stripping layer will remain with the portion of the assemblage to be discarded. These and other advantages are provided by this invention.

Such problems are solved with a photographic assemblage of this invention which comprises:

(a) a photosensitive element comprising a support having thereon at least one photosensitive silver halide emulsion layer;

(b) an image-receiving layer; and (c) a stripping layer located between the silver halide emulsion layer and the image-receiving layer so that the image-receiving layer may be separated, after processing, from the portion of the assemblage containing the silver halide emulsion layer;

and wherein each side of the stripping layer has a hydrophilic layer immediately adjacent thereto, other than a photosensitive silver halide emulsion layer or an image-receiving layer, and only one of the hydrophilic layers contains particulate material substantially insensitive to light and in a volume percentage of about 5 to about 75 percent of the hydrophilic material-particulate material mixture in that layer, so that upon separation, substantially all of the stripping layer will remain with the portion of the assemblage having the hydrophilic layer containing the particulate material.

In a preferred embodiment of the invention, the hydrophilic layer which contains the particulate material is located between the stripping layer and the silver halide emulsion layer so that upon separation, substantially all of the stripping layer will remain with the portion of the assemblage containing the silver halide emulsion layer.

In forming a black-and-white image, the exposed photosensitive element is developed. In the unexposed areas, a silver halide complexing agent dissolves the silver halide and transfers it to the image-receiving layer. Silver precipitating nuclei in the image-receiving layer then cause the transferred silver halide complex to be reduced to silver, thereby forming an image pattern corresponding to the original. Details of the process are well known to those skilled in the art as shown, for example, by U.S. Pat. Nos. 3,220,835 and 3,820,999, the disclosures of which are hereby incorporated by reference.

In a preferred embodiment of the invention, the silver halide emulsion layer has associated therewith a dye image-providing material.

Any material may be employed as the stripping layer in the invention provided it has the required properties. Such materials are disclosed, for example, in U.S. Pat. Nos. 3,220,835, 3,730,718 and 3,820,999 and include gum arabic, sodium alginate, pectin, polyvinyl alcohol and hydroxyethyl cellulose. In a preferred embodiment of this invention, hydroxyethyl cellulose is employed.

The stripping layer materials employed in this invention can be employed in any amount which is effective for the intended purpose. In general, good results have been obtained at a concentration of from about 5 to about 2000 mg/m$^2$ of element. The particular amount to be employed will vary, of course, depending on the particular stripping layer material employed and the particular diffusion transfer element selected.

The materials employed in the hydrophilic layers on each side of the stripping layer in this invention include any of the well known materials commonly used in the photographic art for such use. These materials include, for example, gelatin, polysaccharides, acrylamide polymers and other polymeric materials such as those disclosed in *Research Disclosure,* Vol. 176, December 1978, Item 17643, page 26, the disclosure of which is hereby incorporated by reference. In a preferred embodiment of the invention, gelatin is employed. The coverage of the hydrophilic layer can be widely varied, as desired. In general, good results have been obtained at coverages ranging from about 0.1 to about 2.0 g/m$^2$ of element.

The particulate material employed in the hydrophilic layers of the invention described above can be any material provided it produces the desired results of tightly bonding that layer to the adjacent stripping layer. Such material should not be light-sensitive since it would interfere with the imaging chemistry in the light-sensitive portion of the photosensitive element. In general, good results have been obtained with carbon black, such as Cabot Regal 400® carbon black, average particle diameter 0.07 μm and CITGO (Columbia) Carbon Raven 410®, average particle diameter 0.07 μm; titanium dioxide, such as Gulf and Western Horsehead® Rutile, average particle diameter 0.25 μm; colloidal silica such as DuPont Ludox® AM, average particle diameter 0.012 μm; and poly(methyl methacrylate) beads, average particle diameter 0.5 μm. In a preferred embodiment, carbon black is employed.

The particle size of the particulate material employed in the invention can vary widely, as evidenced by the range of particle sizes shown above. In general, the particle size will range from about 0.01 μm to about 0.5 μm. The amount of particulate material to be coated can also vary widely, as long as the volume percentage of particulate material in the hydrophilic material-particulate material mixture in that layer is from about 5 to about 75 percent. This percentage is commonly referred to in the art as a PVC percentage (pigment volume content). A preferred range of PVC percentages for the invention is from about 10 to about 50 percent.

The amount of particulate material to be coated in the hydrophilic layer is a function of its density. For example, if carbon is to be employed in a hydrophilic layer of gelatin at a PVC of 10 percent, it would be coated at 0.11 g/m$^2$. Similarly, a PVC of 52% would require 0.95 g/m$^2$ of carbon.

Particulate material has been employed in photographic elements for a number of reasons. For example, in U.S. Pat. No. 4,259,518 discussed above, it is disclosed in column 4 that silica particles in the outermost layer prevents blocking when the stripping layer is wound upon itself. Such materials are known in the art as "anti-blocking" agents. It would have been thought, therefore, that such material in a layer would decrease the adhesion of that layer to an adjacent layer. It was unexpectedly found in accordance with this invention, however, that just the opposite occurred. It was found that the hydrophilic layer adjacent the stripping layer which contains the particulate material has a stronger bond to the stripping layer than does the hydrophilic layer on the other side thereof. Since stripping occurs at the weakest interface bond, this enables the stripping layer to remain, after separation, with the portion of the assemblage to be discarded, usually the portion containing the silver halide emulsion layer or layers. Thus, the stripped image-receiving layer in that case will have a clean appearance on the back side thereof.

The employment of particulate material in one of the hydrophilic layers adjacent to the stripping layer in the assemblages described herein is thus the means whereby that bond between those two layers can be strengthened, thus ensuring that stripping will take place at the opposite side of the stripping layer. The hydrophilic layer on the opposite side of the stripping layer should preferably be free, or substantially free, of particulate material since any appreciable amount of particulate material in that layer would tend to strengthen the bond between that layer and the stripping layer, which is undesirable.

This invention can be used in diffusion transfer assemblages where a reflection print is obtained without the bulkiness of silver halide and other layers, the spent pod and trap. In other words, the assemblages of this combines the handling and storage characteristics of conventional photographs with the convenience and benefits of instant photography. Transparencies can also be obtained in the same manner. In addition, transparency elements can also be obtained in accordance with the invention by employing a transparent support and utilizing the retained image in the element along with the subsequent removal of residual image dye, silver halide and opacifying layers. In that embodiment, it would be desirable to have the stripping layer remain with the portion of the assemblage containing the dye image-receiving layer, since that portion is the one to be discarded. In that case, the particulate material would be located in the hydrophilic layer between the stripping layer and the dye image-receiving layer. Clean separation would then occur on the other side of the stripping layer where it is desired.

By removing the silver halide and dye image-providing material layers from the assemblage, there is also provided the option of recovery of these expensive materials from the discarded portion of the assemblage, if it is economically feasible to do so.

A process for producing a photographic image in color according to this invention comprises:

(I) exposing a photosensitive element comprising a support having thereon at least one photosensitive silver halide emulsion layer having associated therewith a dye image-providing material;

(II) treating the element with an alkaline processing composition in the presence of a silver halide developing agent to effect development of each exposed silver halide emulsion layer, whereby:

(a) an imagewise distribution of the dye image-providing material is formed as a function of the development of the silver halide emulsion layer; and (b) at least a portion of the imagewise distribution of the dye image-providing material diffuses to a dye image-receiving layer; and (III) separating the dye image-receiving layer from the rest of the photosensitive element by means of a stripping layer and adjacent hydrophilic layers as described above, so that substantially all of said stripping layer will remain with the portion of the element having the hydrophilic layer containing the particulate material as described above.

The photographic element in the above-described process can be treated with an alkaline processing composition to effect or initiate development in any manner. A preferred method for applying processing composition is by use of a rupturable container or pod which contains the composition.

In a preferred embodiment of the invention the photographic assemblage comprises:

(a) a photosensitive element comprising a support having thereon at least one silver halide emulsion layer having associated therewith a dye image-providing material;

(b) a transparent cover sheet located over the layer outermost from the support of the photosensitive element;

(c) a dye image-receiving layer located either in the photosensitive element or on the transparent cover sheet; and (d) an alkaline processing composition and means containing same for discharge between the photosensitive element and the transparent cover sheet;

and wherein the assemblage contains a stripping layer and adjacent hydrophilic layers as described above.

In a preferred embodiment of the invention, the means containing the alkaline processing composition is a rupturable container or pod which is adapted to be positioned during processing of the film unit so that a compressive force applied to the container by pressure-applying members, such as would be found in a camera designed for in-camera processing, will effect a discharge of the container's contents within the film unit. In general, the processing composition employed in this invention contains the developing agent for development, although the composition could also just be an alkaline solution where the developer is incorporated in the photographic element or cover sheet, in which case the alkaline solution serves to activate the incorporated developer.

The dye image-providing material useful in this invention is either positive- or negative-working, and is either initially mobile or immobile in the photographic element during processing with an alkaline composition. Examples of initially mobile, positive-working dye image-providing materials useful in this invention are described in U.S. Pat. Nos. 2,983,606; 3,536,739; 3,705,184; 3,482,972; 2,756,142; 3,880,658 and 3,854,985. Examples of negative-working dye image-providing materials useful in this invention include conventional couplers which react with oxidized aromatic primary amino color developing agents to produce or release a dye such as those described, for example, in U.S. Pat. No. 3,227,550 and Canadian Pat. No. 602,607. In a preferred embodiment of this invention, the dye image-providing material is a ballasted, redox dye-releasing (RDR) compound. Such compounds are well known to those skilled in the art and are, generally speaking, compounds which will react with oxidized or unoxidized developing agent or electron transfer agent to release a dye. Such nondiffusible RDR's include negative-working compounds, as described in U.S. Pat. Nos. 3,728,113 of Becker et al; 3,725,062 of Anderson and Lum; 3,698,897 of Gompf and Lum; 3,628,952 of Puschel et al; 3,443,939 and 3,443,940 of Bloom et al; 4,053,312 of Fleckenstein; 4,076,529 of Fleckenstein et al; 4,055,428 of Koyama et al; 4,149,892 of Deguchi et al; 4,198,235 and 4,179,291 of Vetter et al; *Research Disclosure* 15157, November, 1976 and *Research Disclosure* 15654, April, 1977. Such nondiffusible RDR's also include positive-working compounds, as described in U.S. Pat. Nos. 3,980,479; 4,139,379; 4,139,389; 4,199,354, 4,232,107, 4,199,355 and German Pat. No. 2,854,946, the disclosures of which are hereby incorporated by reference.

In a preferred embodiment of the invention, RDR's such as those in the Fleckenstein et al patent referred to above are employed. Such compounds are ballasted sulfonamido compounds which are alkali-cleavable upon oxidation to release a diffusible dye from the nucleus and have the formula:

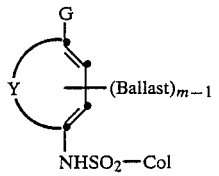

wherein:

(a) Col is a dye or dye precursor moiety;

(b) Ballast is an organic ballasting radical of such molecular size and configuration (e.g., simple organic groups or polymeric groups) as to render the compound nondiffusible in the photosensitive element during development in an alkaline processing composition;

(c) G is OR or NHR$^1$ wherein R is hydrogen or a hydrolyzable moiety and R$^1$ is hydrogen or a substituted or unsubstituted alkyl group of 1 to 22 carbon atoms, such as methyl, ethyl, hydroxyethyl, propyl, butyl, secondary butyl, tertiary butyl, cyclopropyl, 4-chlorobutyl, cyclobutyl, 4-nitroamyl, hexyl, cyclohexyl, octyl, decyl, octadecyl, docosyl, benzyl or phenethyl (when R$^1$ is an alkyl group of greater than 6 carbon atoms, it can serve as a partial or sole Ballast group);

(d) Y represents the atoms necessary to complete a benzene nucleus, a naphthalene nucleus or a 5- to 7-membered heterocyclic ring such as pyrazolone or pyrimidine; and (e) m is a positive integer or 1 to 2 and is 2 when G is OR or when R$^1$ is a hydrogen or an alkyl group of less than 8 carbon atoms.

For further details concerning the above-described sulfonamido compounds and specific examples of same, reference is made to the above-mentioned Fleckenstein et al U.S. Pat. No. 4,076,529.

In another preferred embodiment of the invention, positive-working, nondiffusible RDR's of the type disclosed in U.S. Pat. Nos. 4,139,379 and 4,139,389 are employed. In this embodiment, an immobile compound is employed which as incorporated in a photographic element is incapable of releasing a diffusible dye. However, during photographic processing under alkaline conditions, the compound is capable of accepting at least one electron (i.e., being reduced) and thereafter releases a diffusible dye. These immobile compounds are ballasted electron accepting nucleophilic displacement compounds.

A format for integral negative-receiver photographic elements in which the present invention is useful is disclosed in Canadian Pat. No.928,559. In this embodiment, the support for the photographic element is transparent and is coated with the image-receiving layer, a substantially opaque, light-reflective layer, the stripping layer and adjacent hydrophilic layers described above, and the photosensitive layer or layers described above. A rupturable container, containing an alkaline processing composition including a developing agent and an opacifier, is positioned between the top layer and a transparent cover sheet which has thereon, in sequence, a neutralizing layer, and a timing layer. The film unit is placed in a camera, exposed through the transparent cover sheet and then passed through a pair of pressure-applying members in the camera as it is being removed therefrom. The pressure-applying members rupture the container and spread processing composition and opacifier over the negative portion of the film unit to render it light-insensitive. The processing composition develops each silver halide layer and dye images, formed as a result of development, diffuse to the image-receiving layer to provide a positive, right-reading image which is viewed through the transparent support on the opaque reflecting layer background. For further details concerning the format of this particular integral film unit, reference is made to the above-mentioned Canadian Pat. No. 928,559.

Still other useful integral formats in which this invention can be employed are described in U.S. Pat. Nos. 3,415,644; 3,415,645; 3,415,646; 3,647,437 and 3,635,707. In most of these formats, a photosensitive silver halide emulsion is coated on an opaque support and a dye image-receiving layer is located on a separate transparent support superposed over the layer outermost from the opaque support. In addition, this transparent support also contains a neutralizing layer and a timing layer underneath the dye image-receiving layer.

In another embodiment of the invention, the neutralizing layer and timing layer are located underneath the photosensitive layer or layers. In that embodiment, the photosensitive element would comprise a support having thereon, in sequence, a neutralizing layer, a timing layer and at least one photosensitive silver halide emulsion layer having associated therewith a dye image-providing material. The dye image-receiving layer would be provided on transparent cover sheet with the processing composition being applied therebetween.

The film unit or assemblage of the present invention is used to produce positive images in single or multicolors. In a three-color system, each silver halide emulsion layer of the film assembly will have associated therewith a dye image-providing material which possesses a predominant spectral absorption within the region of the visible spectrum to which said silver halide emulsion is sensitive, i.e., the blue-sensitive silver halide emulsion layer will have a yellow dye image-providing material associated therewith, the green-sensitive silver halide emulsion layer will have a magenta dye image-providing material associated therewith and the red-sensitive silver halide emulsion layer will have a cyan dye image-providing material associated therewith. The dye image-providing material associated with each silver halide emulsion layer is contained either in the silver halide emulsion layer itself or in a layer contiguous to the silver halide emulsion layer, i.e., the dye image-providing material can be coated in a separate layer underneath the silver halide emulsion layer with respect to the exposure direction.

The concentration of the dye image-providing material that is employed in the present invention can be varied over a wide range, depending upon the particular compound employed and the results desired. For example, the dye image-providing material coated in a layer at a concentration of 0.1 to 3 g/m$^2$ has been found to be useful. The dye image-providing material is usually dispersed in a hydrophilic film forming natural material or synthetic polymer, such as gelatin, polyvinyl alcohol, etc, which is adapted to be permeated by aqueous alkaline processing composition.

A variety of silver halide developing agents are useful in this invention. Specific examples of developers or electron transfer agents (ETA's) useful in this invention include hydroquinone compounds, catechol compounds, and 3-pyrazolidinone compounds as disclosed in column 16 of U.S. Pat. No. 4,358,527, issued Nov. 9, 1982. A combination of different ETA's, such as those disclosed in U.S. Pat. No. 3,039,869, can also be employed. These ETA's are employed in the liquid processing composition or contained, at least in part, in any layer or layers of the photographic element or film assemblage to be activated by the alkaline processing composition, such as in the silver halide emulsion layers, the dye image-providing material layers, interlayers, image-receiving layer, etc.

In this invention, in which dye image-providing materials can be used which produce diffusible dye images as a function of development, either conventional negative-working or direct-positive silver halide emulsions can be employed. If the silver halide emulsion employed is a direct-positive silver halide emulsion, such as an internal image emulsion designed for use in the internal image reversal process, or a fogged, direct-positive emulsion such as a solarizing emulsion, which is developable in unexposed areas, a positive image can be obtained on the dye image-receiving layer by using ballasted dye image-providing materials. After exposure of the film assemblage or unit, the alkaline processing composition permeates the various layers to initiate development of the exposed photosensitive silver halide emulsion layers. The developing agent present in the film unit develops each of the silver halide emulsion layers in the unexposed areas (since the silver halide emulsions are direct-positive ones), thus causing the developing agent to become oxidized imagewise corresponding to the unexposed areas of the direct-positive silver halide emulsion layers. The oxidized developing agent then cross-oxidizes the dye image-providing material compounds and the oxidized form of the compounds then undergoes a base-initiated reaction to release the dyes imagewise as a function of the imagewise exposure of each of the silver halide emulsion layers. At least a portion of the imagewise distributions of diffusible dyes diffuse to the image-receiving layer to form a positive image of the original subject. After being contacted by the alkaline processing composition, a neutralizing layer in the film unit or image-receiving unit lowers the pH of the film unit or image receiver to stabilize the image.

Internal image silver halide emulsions useful in this invention are described more fully in the November, 1976 edition of *Research Disclosure,* pages 76 through 79, the disclosure of which is hereby incorporated by reference.

The various silver halide emulsion layers of a color film assembly employed in this invention are disposed in the usual order, i.e., the blue-sensitive silver halide emulsion layer first with respect to the exposure side, followed by the green-sensitive and red-sensitive silver halide emulsion layers. If desired, a yellow dye layer or a yellow colloidal silver layer can be present between the blue-sensitive and green-sensitive silver halide emulsion layers for absorbing or filtering blue radiation that is transmitted through the bluen-sensitive layer. If desired, the selectively sensitized silver halide emulsion layers can be disposed in a different order, e.g., the blue-sensitive layer first with respect to the exposure side, followed by the red-sensitive and green-sensitive layers.

The rupturable container employed in certain embodiments of this invention is disclosed in U.S. Pat. Nos. 2,543,181; 2,643,886; 2,653,732; 2,723,051; 3,056,492; 3,056,491 and 3,152,515. In general, such containers comprise a rectangular sheet of fluid- and air-impervious material folded longitudinally upon itself to form two walls which are sealed to one another along their longitudinal and end margins to form a cavity in which processing solution is contained.

Generally speaking, except where noted otherwise, the silver halide emulsion layers employed in the invention comprise photosensitive silver halide dispersed in gelatin and are about 0.6 to 6 microns in thickness; the dye image-providing materials are dispersed in an aqueous alkaline solution-permeable polymeric binder, such as gelatin, as a separate layer about 0.2 to 7 microns in thickness; and the alkaline solution-permeable polymeric interlayers, e.g., gelatin, are about 0.2 to 5 microns in thickness. Of course, these thicknesses are approximate only and can be modified according to the product desired.

Scavengers for oxidized developing agent can be employed in various interlayers of the photographic elements of the invention. Suitable materials are disclosed on page 83 of the November 1976 edition of *Research Disclosure,* the disclosure of which is hereby incorporated by reference.

Any material is useful as the dye image-receiving layer in this invention, as long as the desired function of mordanting or otherwise fixing the dye images is obtained. The particular material chosen will, of course, depend upon the dye to be mordanted. Suitable materials are disclosed on pages 80 through 82 of the November 1976 edition of *Research Disclosure,* the disclosure of which is hereby incorporated by reference.

Use of a neutralizing material in the film units employed in this invention will usually increase the stability of the transferred image. Generally, the neutralizing material will effect a reduction in the pH of the image layer from about 13 or 14 to at least 11 and preferably 5 to 8 within a short time after imbibition. Suitable materials and their functioning are disclosed on pages 22 and 23 of the July 1974 edition of *Research Disclosure,* and pages 35 through 37 of the July 1975 edition of *Research Disclosure,* the disclosures of which are hereby incorporated by reference.

A timing or inert spacer layer can be employed in the practice of this invention over the neutralizing layer which "times" or controls the pH reduction as a function of the rate at which alkali diffuses through the inert spacer layer. Examples of such timing layers and their functioning are disclosed in the *Research Disclosure* articles mentioned in the paragraph above concerning neutralizing layers.

The alkaline processing composition employed in this invention is the conventional aqueous solution of an alkaline material, e.g, alkali metal hydroxides or carbonates such as sodium hydroxide, sodium carbonate or an amine such as diethylamine, preferably possessing a pH in excess of 11, and preferably containing a developing agent as described previously. Suitable materials and addenda frequently added to such compositions are disclosed on pages 79 and 80 of the November, 1976 edition of *Research Disclosure,* the disclosure of which is hereby incorporated by reference.

The alkaline solution permeable, substantially opaque, light-reflective layer employed in certain embodiments of photographic film units used in this invention is described more fully in the November, 1976 edition of *Research Disclosure,* page 82, the disclosure of which is hereby incorporated by reference.

The supports for the photographic elements used in this invention can be any material, as long as it does not deleteriously affect the photographic properties of the film unit and is dimensionally stable. Typical flexible sheet materials are described on page 85 of the November, 1976 edition of *Research Disclosure,* the disclosure of which is hereby incorporated by reference.

While the invention has been described with reference to layers of silver halide emulsions and dye image-providing materials, dotwise coating, such as would be obtained using a gravure printing technique, could also be employed. In this technique, small dots of blue-, green- and red-sensitive emulsions have associated therewith, respectively, dots of yellow, magenta and cyan color-providing substances. After development, the transferred dyes would tend to fuse together into a continuous tone. In an alternative embodiment, the emulsions sensitive to each of the three primary regions of the spectrum can be disposed as a single segmented layer, e.g., as by the use of microvessels, as described in Whitmore U.S. Pat. No. 4,362,806, issued Dec. 7, 1982.

The silver halide emulsions useful in this invention, both negative-working and direct-positive ones, are well known to those skilled in the art and are described in *Research Disclosure,* Volume 176, December, 1978, Item 17643, pages 22 and 23, "Emulsion preparation and types"; they are usually chemically and spectrally sensitized as described on page 23, "Chemical sensitization", and "Spectral sensitization and desensitization", of the above article; they are optionally protected against the production of fog and stabilized against loss of sensitivity during keeping by employing the materials described on pages 24 and 25, "Antifoggants and stabilizers", of the above article; they usually contain hardeners and coating aids as described on page 26, "Hardeners", and pages 26 and 27, "Coating aids", of the above article; they and other layers in the photographic elements used in this invention usually contain plasticizers, vehicles and filter dyes described on page 27, "Plasticizers and lubricants"; page 26, "Vehicles and vehicle extenders"; and pages 25 and 26, "Absorbing and scattering materials", of the above article; they and other layers in the photographic elements used in this invention can contain addenda which are incorporated by using the procedures described on page 27, "Methods of addition", of the above article; and they are usually coated and dried by using the various techniques described on pages 27 and 28, "Coating and drying procedures", of the above article, the disclosures of which are hereby incorporated by reference.

The term "nondiffusing" used herein has the meaning commonly applied to the term in photography and denotes materials that for all practical purposes do not migrate or wander through organic colloid layers, such as gelatin, in the photographic elements of the invention in an alkaline medium and preferably when processed in a medium having a pH of 11 or greater. The same meaning is to be attached to the term "immobile". The term "diffusible" as applied to the materials of this invention has the converse meaning and denotes materials having the property of diffusing effectively through the colloid layers of the photographic elements in an alkaline medium. "Mobile" has the same meaning as "diffusible".

The term "associated therewith" as used herein is intended to mean that the materials can be in either the same or different layers, so long as the materials are accessible to one another.

The following examples are provided to further illustrate the invention.

EXAMPLE 1

(A) A control integral imaging-receiver (IIR) element was prepared by coating the following layers in the order recited on a transparent poly(ethylene terephthalate) film support. Quantities are parenthetically given in grams per square meter, unless otherwise stated.

(1) Image-receiving layer of poly(styrene-co-N-benzyl-N, N-dimethyl-N-vinylbenzylammonium chloride-co-divinylbenzene) (molar ratio 49/49/2) (1.1) and gelatin (1.2);

(2) Image-receiving layer of poly(styrene-co-1-vinylimidazole-co-3-benzyl-1-vinylimidazolium chloride) (50:40:10 mole ratio) (1.6) and gelatin (0.75);

(3) Reflecting layer of titanium dioxide (17) and gelatin (2.6);

(4) Opaque layer of carbon black (0.95) and gelatin (0.65);

(5) Gelatin interlayer (0.54);

(6) Stripping layer of Natrosol ® GXR-250 hydroxyethyl cellulose (0.81);

(7) Gelatin interlayer (0.65);

(8) Cyan dye releaser B of U.S. Pat. No. 4,356,250 (0.37) and gelatin (0.54); and (9) Gelatin overcoat (0.43).

It should be noted that layers 8 and 9 represent the top and bottom layers of a complete IIR such as described in Example 1 of U.S. Pat. No. 4,356,250. For purposes of this test, it was not necessary to have a complete light-sensitive element.

(B) An IIR similar to (A) was prepared except that layer 7 also contained poly(methylmethacrylate) beads (0.56), average particle diameter 0.5 μm, PVC 47%.

(C) An IIR similar to (A) was prepared except that layer 7 also contained poly(methylmethacrylate) beads (0.18), average particle diameter 0.5 μm, PVC 22%.

(D) An IIR similar to (A) was prepared except that layer 7 also contained DuPont Ludox ® AM colloidal silica (0.95), average particle diameter 0.012 μm, PVC 47%.

(E) An IIR similar to (A) was prepared except that layer 7 also contained DuPont Ludox ® AM colloidal silica (0.32), average particle diameter 0.012 μm, PVC 23%.

(F) An IIR similar to (A) was prepared except that layer 7 also contained Cabot Regal 400 carbon black (0.95), average particle diameter 0.07 μm, PVC 50%.

(G) An IIR similar to (A) was prepared except that layer 7 also contained Cabot Regal 400 carbon black (0.32), average particle diameter 0.07 μm, PVC 25%.

(H) An IIR similar to (A) was prepared except that layer 7 also contained Gulf and Western Horsehead Rutile titanium dioxide (1.8), average particle diameter 0.25 μm, PVC 48%.

(I) An IIR similar to (A) was prepared except that layer 7 also contained Gulf and Western Horsehead Rutile titanium dioxide (0.59), average particle diameter 0.25 μm, PVC 24%.

The above coatings were prepared with nearly constant PVC percentages of particulate material, thus the actual coated weights vary. Each material was coated at a 1X and 3X level.

A "tape test" was run on the above IIR's. This test has a high correlation with actual stripping performances in actual photographic coatings. The test consists of firmly applying a short strip of 3M Scotch ® 810

Magic Transparent Tape on the top of layer 9 of the IIR to be tested and then rapidly pulling on the tape.

IIR's B through I thus tested stripped at the point between layers 6 and 5, thus indicating the weakest bond in the element. In control IIR A, a random discontinuous stripping occurred.

A second tape test was run on the residual element on top of layer 6 to determine the next weakest bond. If layer 6 was not removed by this second test, then the bond between layers 7 and 6 was considered to be strong. If layer 6 was removed by the second tape test, then the bond was considered to be weak (but none-the-less stronger than the bond between layers 6 and 5).

The following results were obtained:

TABLE 1

| IIR | Particulate Material in Layer 7 (g/m$^2$) | PVC | Bond Between Layers 5 and 6 | Bond Between Layers 6 and 7 |
|---|---|---|---|---|
| A (Control) | none | — | Weak (discontinuous stripping) | Weak |
| B | poly(methylmethacrylate) beads (0.56) | 47 | Weakest | Strong |
| C | poly(methylmethacrylate) beads (0.18) | 22 | Weakest | Weak |
| D | silica (0.95) | 47 | Weakest | Strong |
| E | silica (0.32) | 23 | Weakest | Weak |
| F | carbon black (0.95) | 50 | Weakest | Strong |
| G | carbon black (0.32) | 25 | Weakest | Weak |
| H | titanium dioxide (1.8) | 48 | Weakest | Strong |
| I | titanium dioxide (0.59) | 24 | Weakest | Weak |

The above results indicate that in all instances, employing particulate material in a hydrophilic layer adjacent a stripping layer improves the adhesion between those two layers, thus causing stripping to occur on the opposite side of the stripping layer. In IIR elements B, D, F and H, a strong bond was obtained between layers 6 and 7 due to the higher concentration of particulate material employed.

EXAMPLE 2

(A) An IIR similar to that of (A) in Example 1 was prepared except that after layer 7, the following layers were employed:

(8) Cyan redox dye-releaser layer,
(9) Gelatin interlayer,
(10) Red-sensitive silver halide emulsion layer,
(11) Gelatin interlayer,
(12) Magenta redox dye-releaser layer,
(13) Green-sensitive silver halide emulsion layer,
(14) Gelatin interlayer,
(15) Yellow redox dye-releaser layer,
(16) Blue-sensitive silver halide emulsion layer, and
(17) Gelatin overcoat layer.

Layers 8-17 are similar to those described in Example 1 of U.S. Pat. No. 4,356,250 of Irani et al.

(B) An IIR similar to (A) was prepared except that layer 7 also contained DuPont Ludox® AM colloidal silica (0.11), average particle diameter 0.012 μm, PVC of 9.

(C) An IIR similar to (A) was prepared except that layer 7 also contained DuPont Ludox® AM colloidal silica (0.32), average particle diameter 0.012 μm, PVC of 23.

(D) An IIR similar to (A) was prepared except that layer 7 also contained DuPont Ludox® AM colloidal silica (0.65), average particle diameter 0.012 μm, PVC of 38.

(E) An IIR similar to (A) was prepared except that layer 7 also contained DuPont Ludox® AM colloidal silica (0.95), average particle diameter 0.012 μm, PVC of 48.

(F) An IIR similar to (A) was prepared except that layer 7 also contained CITGO (Columbia) Carbon Raven 410® carbon black (0.11), average particle diameter 0.07 μm, PVC of 10.

(G) An IIR similar to (A) was prepared except that layer 7 also contained CITGO (Columbia) Carbon Raven 410® carbon black (0.32), average particle diameter 0.07 μm, PVC of 25.

(H) An IIR similar to (A) was prepared except that layer 7 also contained CITGO (Columbia) Carbon Raven 410® carbon black (0.65), average particle diameter 0.07 μm, PVC of 40.

(I) An IIR similar to (A) was prepared except that layer 7 also contained CITGO (Columbia) Carbon Raven 410® carbon black (0.95), average particle diameter 0.07 μm, PVC of 52.

A cover sheet and processing pod were also prepared similar to those in Example 1 of U.S. Pat. No. 4,356,250, and assembled into film assemblages.

The above film assemblages were exposed to a graduated density color test object (to verify that the stripping layer and adjacent hydrophilic layer had no sensitimetric effect). The assemblages were then processed by spreading the contents of the processing pod between the cover sheet and IIR by using a pair of juxtaposed rollers. The film assemblages, as assembled, were then incubated for 1 week at room temperature, 3 weeks at room temperature, and 3 weeks at 32° C./15% RH. Each assemblage was then manually peeled apart to separate the receiver portion from the upper silver halide emulsion layers.

Ideally, separation should occur between layers 5 and 6 (designated as location 1). Sometimes the separation occurred between layers 6 and 7 (designated as location 2). This leaves objectionably visible irregular shaped areas of the stripping layer on the back of the peeled receiver. In other instances, separation occurred in various locations from layer 8 upward (designated as location 3). This is the least desirable point of separation as the emulsion layer(s) and dye releaser layer(s) are retained on the element with the image and may cause stain problems in addition to being visually objectionable.

The data below show the stripping behavior for the different particulate materials in layer 7, coated adjacent to stripping layer 6. The area percent separation is tabulated by locations 1/2/3. Ideal separation would thus be 100/0/0; 100 area percent separation between layers 5 and 6 for both wet (center) and dry (edge) areas. Very poor separation, such as 30/60/10, indicates that less than one-third of the area separated between layers 5 and 6, almost two-thirds of the stripping layer was retained on the back of the separated receiver, and significant portions of the emulsion layers were fractured.

Separation is initiated in the dry outer mask area of the assemblage and continues through the initially wet center image area. Thus, clean separation is desirable within both the dry and wet areas of the assemblage as well as at the interface. The following results were obtained:

TABLE 2

| IIR | Particulate Material in Layer 7 (g/m²) | PVC | Incubated 1 week at RT Area % Stripping at Location 1/2/3 Dry | Incubated 1 week at RT Area % Stripping at Location 1/2/3 Wet | Incubated 3 weeks at RT Area % Stripping at Location 1/2/3 Dry | Incubated 3 weeks at RT Area % Stripping at Location 1/2/3 Wet | Incubated 3 weeks at 32° C./15% RH Area % Stripping at Location 1/2/3 Dry | Incubated 3 weeks at 32° C./15% RH Area % Stripping at Location 1/2/3 Wet |
|---|---|---|---|---|---|---|---|---|
| A | none (control) | 0 | 80/20/0 | 90/10/0 | 80/20/0 | 55/45/0 | 85/15/0 | 30/60/10 |
| B | silica (0.11) | 9 | 85/15/0 | 95/5/0 | 90/10/0 | 70/30/0 | 90/10/0 | 75/20/5 |
| C | silica (0.32) | 23 | 90/10/0 | 95/5/0 | 100/0/0 | 85/15/0 | 95/5/0 | 75/20/5 |
| D | silica (0.65) | 38 | 90/10/0 | 95/5/0 | 100/0/0 | 100/0/0 | 100/0/0 | 95/5/0 |
| E | silica (0.95) | 48 | 75/25/0 | 100/0/0 | 100/0/0 | 100/0/0 | 100/0/0 | 98/0/2 |
| F | carbon black (0.11) | 10 | 90/10/0 | 95/5/0 | 95/5/0 | 75/25/0 | 90/10/0 | 75/20/5 |
| G | carbon black (0.32) | 25 | 95/5/0 | 100/0/0 | 100/0/0 | 90/10/0 | 100/0/0 | 75/15/10 |
| H | carbon black (0.65) | 40 | 100/0/0 | 100/0/0 | 100/0/0 | 100/0/0 | 100/0/0 | 80/0/20 |
| I | carbon black (0.95) | 52 | 100/0/0 | 100/0/0 | 100/0/0 | 100/0/0 | 100/0/0 | 90/0/10 |

The above results indicate that the addition of particulate material to layer 7 improved both wet and dry stripping. In most cases, improved separation between layers 5 and 6 was obtained as the quantity of silica or carbon black was increased. Very high levels should be avoided, however, as problems will arise with poor layer integrity (spontaneous separation) and brittleness.

The invention has been described in detail with particular reference to preferred embodiments thereof, but it will be understood that variations and modifications can be effected within the spirit and scope of the invention.

What is claimed is:

1. In a photographic assemblage comprising:

(a) a photosensitive element comprising a support having thereon at least one photosensitive silver halide emulsion layer;

(b) an image-receiving layer; and (c) a stripping layer located between said silver halide emulsion layer and said image-receiving layer so that said image-receiving layer may be separated, after processing, from the portion of said assemblage containing said silver halide emulsion layer;

the improvement wherein each side of said stripping layer has a hydrophilic layer immediately adjacent thereto, other than a photosensitive silver halide emulsion layer or an image-receiving layer, and only one of said hydrophilic layers contains particulate material substantially insensitive to light and in a volume percentage of from about 5 to about 75 percent of the hydrophilic material-particulate material mixture in that layer, so that upon separation, substantially all of said stripping layer will remain with the portion of said assemblage having said hydrophilic layer containing said particulate material.

2. The assemblage of claim 1 wherein said hydrophilic layer which contains said particulate material is located between said stripping layer and said silver halide emulsion layer so that upon separation, substantially all of said stripping layer will remain with said portion of said assemblage containing said silver halide emulsion layer.

3. The assemblage of claim 2 which also contains an alkaline processing composition and means containing same for discharge within said assemblage.

4. The assemblage of claim 3 wherein said image-receiving layer contains silver precipitating nuclei.

5. The assemblage of claim 3 wherein said silver halide emulsion layer has associated therewith a dye image-providing material.

6. The assemblage of claim 5 wherein said stripping layer comprises hydroxyethyl cellulose.

7. The assemblage of claim 5 wherein said particulate material comprises carbon black, titanium dioxide, silica or poly(methyl methacrylate) beads.

8. The assemblage of claim 5 wherein each said hydrophilic layer comprises gelatin.

9. The assemblage of claim 8 wherein said particulate material is carbon black.

10. The assemblage of claim 5 wherein said particulate material has an average particle diameter of from about 0.01 μm to about 0.5 μm and is present in a volume percentage of from about 10 to about 50 percent of the hydrophilic material-particulate material mixture in that layer.

11. The assemblage of claim 5 wherein said photosensitive element comprises a support having thereon a red-sensitive silver halide emulsion layer having a cyan dye image-providing material associated therewith, a green-sensitive silver halide emulsion layer having a magenta dye image-providing material associated therewith, and a blue-sensitive silver halide emulsion layer having a yellow dye image-providing material associated therewith.

12. The assemblage of claim 5 wherein said dye image-providing material is a ballasted sulfonamido compound which is alkali-cleavable upon oxidation to release a diffusible color-providing moiety, said compound having the formula:

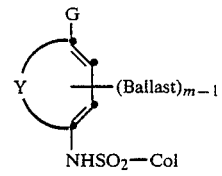

wherein:

(a) Col is a dye or dye precursor moiety;

(b) Ballast is an organic ballasting radical of such molecular size and configuration as to render said compound nondiffusible in said photosensitive element during development in an alkaline processing composition;

(c) G is OR or $NHR^1$ wherein R is hydrogen or a hydrolyzable moiety and $R^1$ is hydrogen or an alkyl group of 1 to 22 carbon atoms;

(d) Y represents the atoms necessary to complete a benzene nucleus, a naphthalene nucleus or a 5- to 7-membered heterocyclic ring; and (e) m is a positive integer of 1 to 2 and is 2 when G is OR or when $R^1$ is hydrogen or an alkyl group of less than 8 carbon atoms.

13. The assemblage of claim 5 wherein:

(a) said image-receiving layer is located in said photosensitive element between said support and said silver halide emulsion layer; and (b) said assemblage also includes a transparent cover sheet over the layer outermost from said support.

14. The assemblage of claim 13 wherein said transparent cover sheet is coated with, in sequence, a neutralizing layer and a timing layer.

15. The assemblage of claim 14 wherein said discharging means is a rupturable container containing said alkaline processing composition and an opacifying agent, said container being so positioned during processing of said assemblage that a compressive force applied to said container will effect a discharge of the container's contents between said transparent sheet and the layer outermost from said support.

16. The assemblage of claim 5 wherein said support of said photosensitive element is opaque, and said image-receiving layer is located on a separate transparent support superposed on the layer outermost from said opaque support.

17. The assemblage of claim 16 wherein said transparent support has thereon, in sequence, a neutralizing layer, a timing layer and said image-receiving layer.

18. The assemblage of claim 16 wherein said opaque support has thereon, in sequence, a neutralizing layer, a timing layer and said silver halide emulsion layer.

19. The assemblage of claim 5 wherein said support of said photosensitive element is transparent.

20. An integral photographic assemblage comprising:

(a) a photosensitive element comprising a transparent support having thereon the following layers in sequence: a dye image-receiving layer; an alkaline solution-permeable, light-reflective layer; an alkaline solution-permeable, opaque layer; a hydrophilic layer; a stripping layer which enables said dye image-receiving layer to be separated, after processing, from the rest of said assemblage; a hydrophilic layer; a red-sensitive silver halide emulsion layer having a cyan dye image-providing material associated therewith; a green-sensitive silver halide emulsion layer having a magenta dye image-providing material associated therewith; and a blue-sensitive, silver halide emulsion layer having a yellow dye image-providing material associated therewith;

(b) a transparent cover sheet superposed over said blue-sensitive silver halide emulsion layer and comprising a transparent support having therein, in sequence, a neutralizing layer and a timing layer; and (c) a rupturable container containing an alkaline processing composition and an opacifying agent, said container being so positioned during processing of said assemblage that a compressive force applied to said container will effect a discharge of the container's contents between said transparent cover sheet and said blue-sensitive silver halide emulsion layer;

and wherein said hydrophilic layer which is located between said stripping layer and said red-sensitive silver halide emulsion layer contains particulate material substantially insensitive to light and in a volume percentage of from about 5 to about 75 percent of the hydrophilic material-particulate material mixture in that layer, so that upon separation, substantially all of said stripping layer will remain with the portion of said assemblage containing said silver halide emulsion layers.

21. The assemblage of claim 20 wherein said stripping layer comprises hydroxyethyl cellulose.

22. The assemblage of claim 20 wherein said particulate material comprises carbon black, titanium dioxide, silica or poly(methyl methacrylate) beads.

23. The assemblage of claim 22 wherein said particulate material has an average particle diameter of from about 0.01 μm to about 0.5 μm and is present in a volume percentage of from about 10 to about 50 percent of the hydrophilic material-particulate material mixture in that layer.

24. The assemblage of claim 20 wherein each said hydrophilic layer comprises gelatin.

25. The assemblage of claim 24 wherein said particulate material is carbon black.

26. The assemblage of claim 25 wherein said stripping layer comprises hydroxyethyl cellulose.

27. A process for producing a photographic image in color comprising:

(I) exposing a photosensitive element comprising a support having thereon at least one photosensitive silver halide emulsion layer having associated therewith a dye image-providing material;

(II) treating said element with an alkaline processing composition in the presence of a silver halide developing agent to effect development of each said exposed silver halide emulsion layer, whereby:

(a) an imagewise distribution of said dye image-providing material is formed as a function of said development of said silver halide emulsion layer; and (b) at least a portion of said imagewise distribution of said dye image-providing material diffuses to a dye image-receiving layer; and (III) separating said dye image-receiving layer from the rest of said photosensitive element, said separation being facilitated by means of a stripping layer located between said silver halide emulsion layer and said dye image-receiving layer, and wherein each side of said stripping layer has a hydrophilic layer immediately adjacent thereto, other than a photosensitive silver halide emulsion layer or an image-receiving layer, and only one of said hydrophilic layers contains particulate material substantially insensitive to light and in a volume percentage of from about 5 to about 75 percent of the hydrophilic material-particulate material mixture in that layer, so that substantially all of said stripping layer will remain with the portion of said element having said hydrophilic layer containing said particulate material.

28. The process of claim 27 wherein said hydrophilic layer which contains said particulate material is located between said stripping layer and said silver halide emulsion layer so that upon separation, substantially all of said stripping layer will remain with said portion of said element containing said silver halide emulsion layer.

29. The process of claim 28 wherein said stripping layer comprises hydroxyethyl cellulose.

30. The process of claim 28 wherein said particulate material comprises carbon black, titanium dioxide, silica or poly(methyl methacrylate) beads.

31. The process of claim 30 wherein said particulate material has an average particle diameter of from about 0.01 μm to about 0.5 μm and is present in a volume percentage of from about 10 to about 50 percent of the hydrophilic material-particulate material mixture in that layer.

32. The process of claim 28 wherein each said hydrophilic layer comprises gelatin.

33. The process of claim 32 wherein said particulate material is carbon black.

34. The process of claim 33 wherein said stripping layer comprises hydroxyethyl cellulose.

* * * * *